US005145446A

United States Patent [19]

Kuo

[11] Patent Number: 5,145,446

[45] Date of Patent: Sep. 8, 1992

[54] RETRACTABLE TOY SWORD WITH VIDEO AND SOUND EFFECT

[76] Inventor: Yi-Yu Kuo, 14, Lane 616, Chengteh Rd., Taipei, Taiwan

[21] Appl. No.: 764,173

[22] Filed: Sep. 23, 1991

[51] Int. Cl.[5] ..... A63H 5/04; A63H 33/30; A63H 33/26; A63H 33/00

[52] U.S. Cl. ..... 446/405; 446/473; 446/485; 446/487

[58] Field of Search ..... 446/484, 485, 69, 144, 446/219, 397, 398, 401, 404, 405, 407, 411, 412, 473, 487, 489, 490

[56] References Cited

U.S. PATENT DOCUMENTS

| | | | |
|---|---|---|---|
| 2,672,707 | 3/1954 | Greenhaus | 446/144 |
| 2,759,294 | 8/1956 | Tigrett | 446/473 |
| 2,922,250 | 1/1960 | Ayala | 446/144 |
| 3,037,320 | 6/1962 | Powell | 446/473 |
| 3,407,514 | 10/1968 | Christian | 446/69 X |
| 4,231,077 | 10/1980 | Joyce et al. | 446/485 X |
| 4,678,450 | 7/1987 | Scolari et al. | 446/473 X |
| 4,717,365 | 1/1988 | Anderson et al. | 446/473 X |
| 4,808,143 | 2/1989 | Kuo | 446/473 X |
| 4,869,704 | 9/1989 | Fisher | 446/473 X |
| 4,904,222 | 2/1990 | Gastgeb et al. | 446/408 X |

FOREIGN PATENT DOCUMENTS

| | | | |
|---|---|---|---|
| 2221626 | 2/1990 | United Kingdom | 446/485 |

*Primary Examiner*—David N. Muir
*Attorney, Agent, or Firm*—Bacon & Thomas

[57] ABSTRACT

Disclosed is a retractable toy sword with visual and sound effects having a sword, a retraction driver, and a visual and sound effects driving circuit. The sword is divided into a hilt and a blade. The hilt is a hollow structure, and the blade is composed of at least two blade sections, each having a hollow interior space for holding a spring, and each having an L-like front end, and an L-like rear end for mutual engagement during extension and retraction. The retraction driver is placed within the hilt to control extension and retraction of the blade. The visual and sound effects driving circuit is also located in the hilt. It can generate a variety of noises, such as a collision noise "Dang" and a flying noise "Hee", as well as a directed emission of light by reflection and convergence at a reflective hood and a convergent lens.

5 Claims, 4 Drawing Sheets

RETRACTABLE TOY SWORD WITH VIDEO AND SOUND EFFECT

BACKGROUND OF THE INVENTION

The present invention relates to a toy sword, particularly a retractable toy sword with visual and sound effects.

As a weapon in the history of human beings, the sword is also a symbol of status. There are a lot of stories about heroes and their weapons. In some novels, swords are something miraculous and they can emit different types of light. Today, the sword is a tool for sport and a decoration as well. Moreover, they are available as toys in the market, mostly for boys. Most boys like swords, for they can play with swords by imaging themselves as heroes in many movies and comics. However, though there are numerous toy swords in the market, none of them have any particular function which can satisfy the children, and moreover, the design of such swords may be risky for children because of their offensive nature. However, it is more dangerous if stick or the like rather than toy sword is used in playing the game of hero.

Though there have been some improvements in the structures of toy swords, such as a retractable sword formed by a hilt and blade sections, its use of a spring for rapid extension is still dangerous for children because such rapid extension may injure children's eyes. It is not ideal because a considerable force is required to retract the toy sword.

SUMMARY OF THE INVENTION

In view of the above defects, the inventor created a retractable toy sword with visual and sound effects. It provides new functions for toy swords by design of automatic extension and retraction and, generation of visual and sound effects—emission of light and generation of a variety of sounds, such as collision noise "Dang" and flying noise "Hee" to satisfy children's curiosity. Moreover the present invention can provide the children with a sense of justice, since it is designed as a miraculous sword for the real hero. Its retraction mechanism can extend and retract the blade slowly to prevent injury to children, and to minimize the risk from using of it as a toy.

BRIEF DESCRIPTION OF THE DRAWINGS

These and other objects and features of the invention will become more apparent from the following description taken in connection with the accompanying drawings wherein.

DETAILED DESCRIPTION OF THE PREFERRED EMBODIMENT

Figure 1:
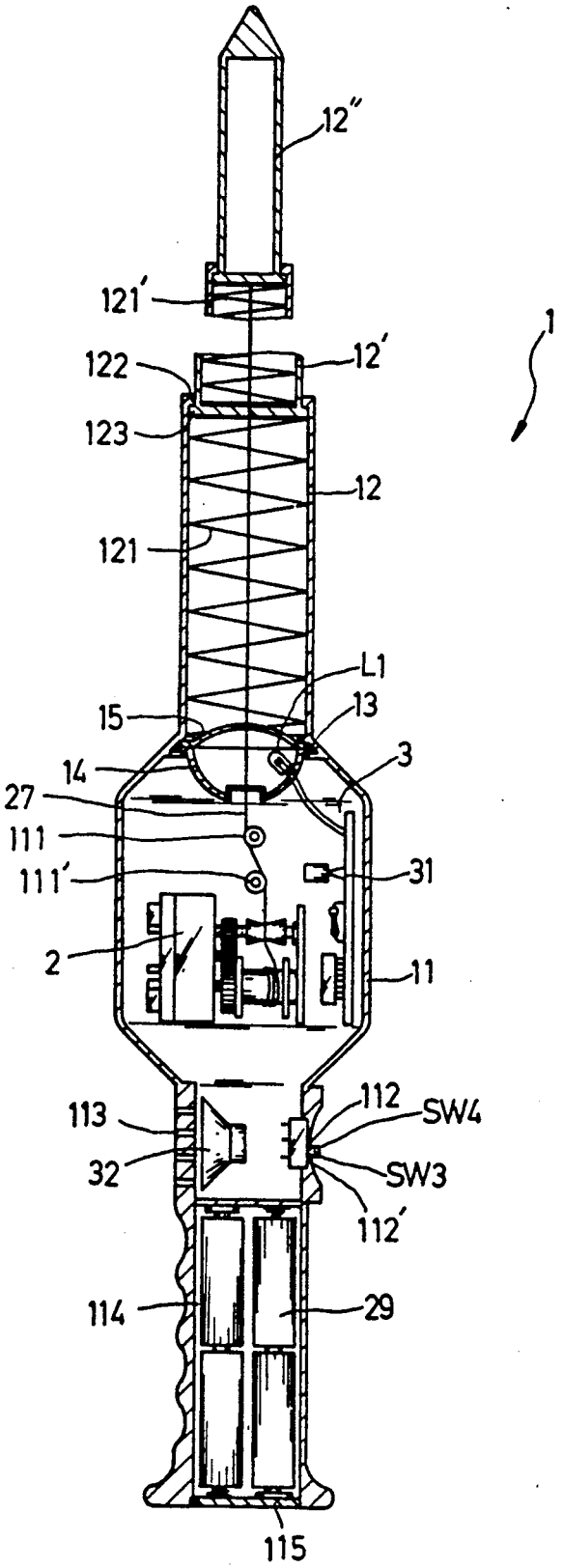
FIG. 1 is a sectional view of a retractable toy sword with visual and sound effects according to the present invention.
Figure 2:
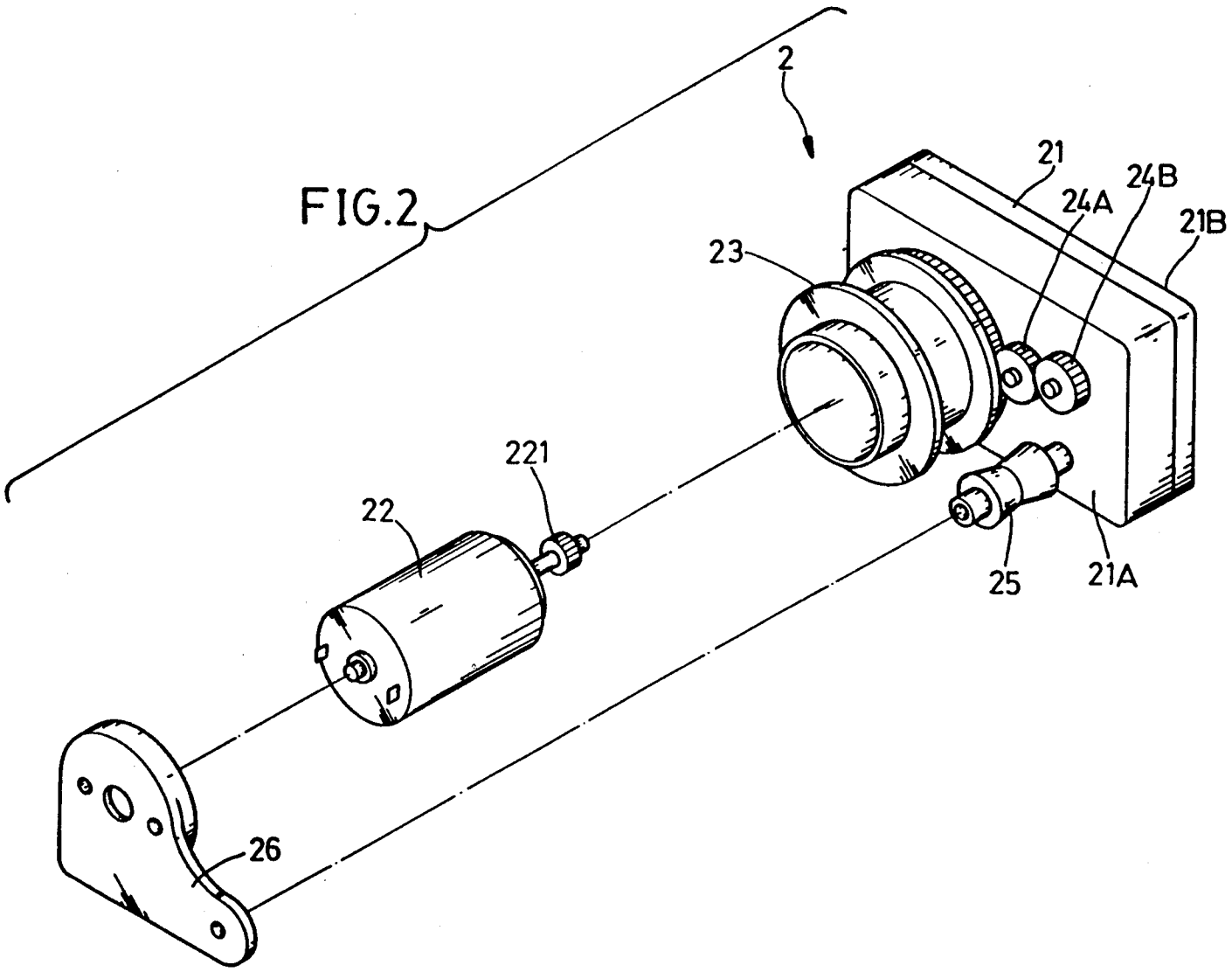
FIG. 2 is a fragmental view of a retraction driver for the retractable toy sword with visual and sound effects according to the present invention.
Figure 3:
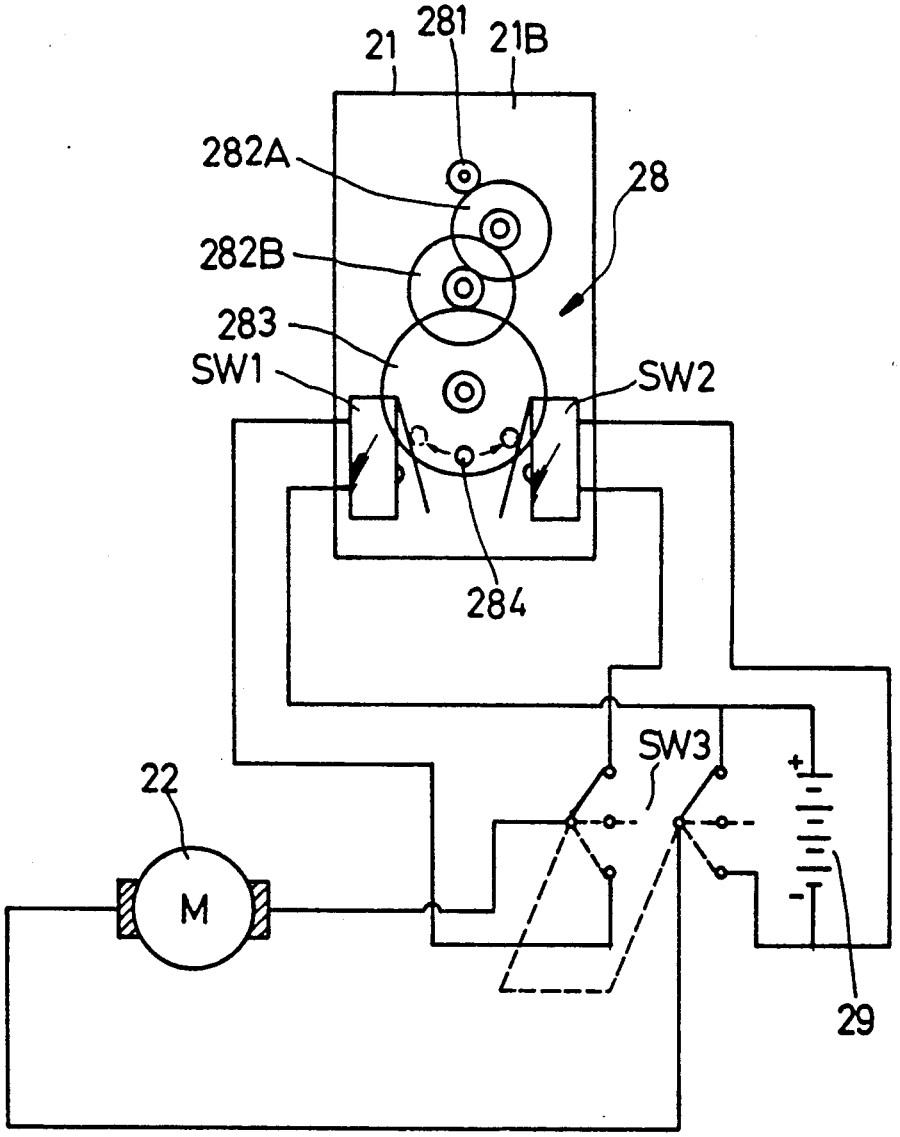
FIG. 3 is a schematic circuit diagram for the retraction driver in the retractable toy sword with visual and sound effects according to the present invention.

Please refer to FIG. 1 for a sectional view of a retractable toy sword with visual and sound effects according to the present invention. The sword body 1 is divided into two parts: a hilt 11 and a blade 12. The hilt 11 has a hollow front section with two guide posts 111 and 111' in the middle, two openings 112 and 112' for switches at a side of a middle section and an opening 113 for a speaker at the opposite side of the middle section, and a battery chamber 114 with a cover 115 in the bottom section. The blade 12 is composed of at least two blade sections 12' and 12''. Each blade section 12' or 12'' is a hollow structure containing a spring 121 or 121', and has a L-like front end 122 and a L-like rear end 123 for mutual engagement during extension or retraction. A groove 13 is designed at the junction between the hilt 11 and the blade 12 for installation of a reflective hood 14 and a convergent lens 15. A round hold penetrates the center of the reflective hood 14 and the convergent lens 15, and a round hold is designed at the lower right side of the refelective hood 14.

The present invention includes a retraction driver 2 composed of a reduction gear box 21, a motor 22, a pulley 23, two transmission gears 24A and 24B, a roller 25, a motor cover 26, a steel cable 27, a timing gear train 28, two micro switches SW1 and SW2, a slide switch SW3, and a battery 29 located within the hollow front section of the hilt 11. The slide switch SW3 is placed at the opening 112 of the hilt 11, and the battery 29 is loaded in the battery chamber 114 in the hilt 11. The reduction gear box 21 contains a reduction gear. The motor 22 is fixed to the back 21A of the reduction gear box 21. A pinion 221 is installed at the shaft of the motor 22 for engaging the reduction gear in the reduction gear box 21. The pulley 23 has a substantially U-like left end, a gear at its right end, and a circular hollow center for insertion of the motor 22. The roller 25 is located on the back 21A of the reduction gear box 21 and locked by the motor cave 26. An end of the cable 27 is fixed on the pulley 23, and its other end passes over the roller 25, the guide posts 111 and 111' of the hilt 11, the central holes of the reflective hood 14 and the convergent lens 15, the interior space of the blade 12 and is fixed to the last blade section 12''. The timing gear train 28 is installed on the front side 21B of the reduction gear box 21, with a micro switch SW1 at the left side and another micro switch SW2 at the right side so that the motor 22 can be controlled for normal or reverse rotation, and consequently the blade 12 can be controlled for extending or retracting by sliding the slide switch SW3, while the corresponding micro switch SW1 or SW2 serves to control its position and turn off power source. The timing gear train 28, located on the front side 21B of the reduction gear box 21, comprises a driving gear 281, two reduction gears 282A and 282B, a positioning gear 283, and a stop lever 284. The driving gear 281 is driven by the reduction gear in the reduction gear box 21. The driving gear 281 and the transmission gear 24B rotates synchronously. After reduction by the reduction gears 282A and 282B, the driving gear 281 drives the positioning gear 283. The positioning gear 283 is incorporated with a stop lever 284 to push a micro switch SW1 or SW2 at its left or rights side when the blade 12 has fully extended or retracted in order to cut off the power source and stop the motor.

The present invention includes a visual and sound effects driving circuit composed of a base board, an integrated circuit IC1, two transistors Q1 and Q2, a capacitor C1, five resistors R1, R2, R3, R4 and R5, a speaker 32, a slide switch SW4, and a bulb L1, all located on the base board as per its layout diagram, and fixed in the hollow front section of the hilt 11 in a way that the speaker 32 is fixed at the opening 113, and the slide switch SW4 is fixed in the opening 112' of the hilt 11. Power for the visual and sound effects driving circuit 3 is provided by the battery 29 in the retraction driver 2. By turning on the slide switch SW4, the circuit 3 can provide sound and light. The light is reflected and converged by the reflective hood 14 and the convergent lens 15, and directed to emit upwards.

Figure 4:
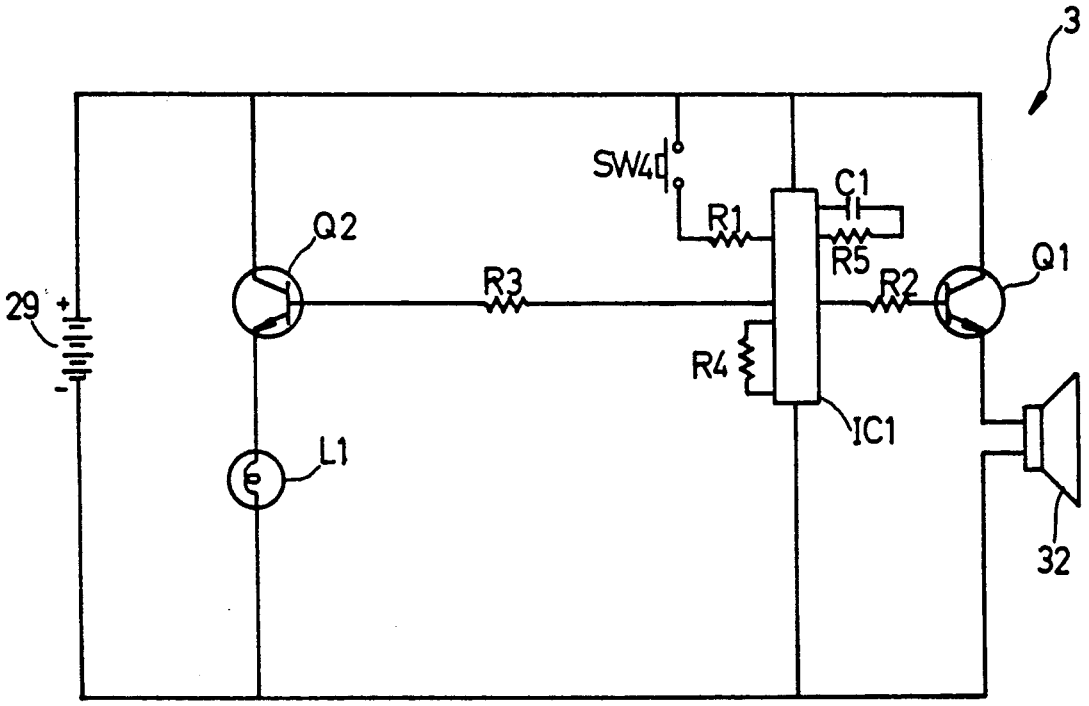
FIG. 4 is a schematic circuit diagram for a visual and sound effects driving circuit in the retractable toy sword with visual and sound effects according to the present invention.

FIG. 4 shows a circuit diagram for the visual and sound effects driving circuit 3 according to the present invention. The battery 29 is the power source for all circuits in the present invention. When the slide switch SW4 is ON, the integrated circuit IC1 receives power through the resistor R1 and generates a signal to read a variety of collision noise "Dang" and flying noise "Hee" stored in a read only memory ROM. The noises are amplified by the resistor R1 and the transistor Q1, and given out by the speaker 32. At the same time, the integrated circuit IC1 gives an oscillating signal. The signal, after amplification by the resistor R3 and the transistor Q2, lights the bulb so as to flicker.

As described above, the retractable toy sword with audio and visual effects according to the present invention comprises a sword, a retraction driver, and a visual and sound effects driving circuit. The sword can be divided into two parts: a hilt and a blade. The hilt is a hollow structure, and the blade is composed of at least two blade sections, each having a hollow interior space for holding a spring, and each has L-like front end, and an L-like rear end for mutual engagement during extension and retraction. The retraction driver is placed within the hilt to control extension and retraction of the blade. The visual and sound effects driving circuit is located in the hilt too. It can generate a variety of noises, such as a collision noise "Dang" and a flying noise "Hee", and a directed emission of light by reflection and convergence at a reflective hood and a convergent lens.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A retractable toy sword with visual and sound effects comprising:

a sword, including: a hilt defining a hollow front section having two guide posts in a middle portion, two openings for slide switches at a side and an opening for a speaker at an opposite side, a battery chamber with a cover and a rear section; and a blade composed of at least two telescopic sections, each section defining a hollow interior space for holding a spring, and means for mutual engagement during extension and retraction;

a retraction driver located within the hilt to control the at least two telescopic sections of the blade for extension and retraction, wherein the retraction driver comprises: a reduction gear box, a motor, a pulley, two transmission gears, a roller , a motor cover, a steel cable, a timing gear train, two micro switches, a slide switch, such that the slide switch is placed in an opening for a slide switch defined by the hilt; wherein: the reduction gear box contains a reduction gear; the motor has a shaft and is fixed to the back of the reduction gear box; a pinion is installed on the shaft of the motor for engaging the reduction gear in the reduction gear box; a pulley having a substantially U-like left side, a gear at its right side, and a circular hollow center adapted to accommodate the motor, and it is engaged with a transmission gear at a back of the reduction gear box and driven by another transmission gear engaged with the reduction gear in the reduction gear box; a roller is operatively associated with the back of the reduction gear box; an end of a cable is fixed on the pulley and passes over the roller, the guide posts of the hilt, and another end is fixed to a last blade section; a timing gear train is installed on a front side of the reduction gear box with a first micro switch at the left side and a second micro switch at the right side so that the motor can be controlled for normal or reverse rotation, and consequently the blade can be controlled for extending or retracting by sliding the slide switch, while the corresponding micro switch serves to control its position and turn off a power source; and a visual and sound effects driving circuit located within the hilt for generation of a variety of visual and sound effects.

2. A retractable toy sword with visual and sound effect as claimed in claim 1 wherein the timing gear train is located on a front side of the reduction gear box and comprises a driving gear, two reduction gears, a positioning gear, and a stop lever, such that the driving gear is driven by the reduction gear in the reduction gear box, the driving gear and the transmission gear rotate synchronously, and after reduction by the two reduction gears, the driving gear drives the positioning gear; the positioning gear is incorporated with a stop lever to operate one of the first and second micro switches at its left side or right side when the blade has fully expanded or retracted in order to cut off the power source and stop the motor.

3. A retractable toy sword with visual and sound effect as claimed in claim 1 wherein the visual and sound effect driving circuit comprises a base board, an integrated circuit, two transistors, a capacitor, five resistors, a speaker, a slide switch, and a light bulb, all placed on the base board, and fixed in a hollow front section of the hilt such that the speaker is fixed at the opening for speaker, and the slide switch is fixed in an opening for slide switch defined by the hilt, with power provided by a battery in the retraction driver; such that by turning on of the slide switch, the circuit can provide a sound and a light effect.

4. A retractable toy sword with visual and sound effect as claimed in claim 1 wherein a groove is defined at the junction between the hilt and the blade for installation of a reflective hood and a convergent lens, first and second round holes defined at the center of the reflective hood and the convergent lens to accommodate the passing through of the cable, and a third round hole defined at the lower right side of the reflective hood for fixing of the bulb of the visual and sound effects driving circuit in order to emit light from the light bulb in a fixed direction.

5. A retractable toy sword with visual and sound effects as claimed in claim 1 wherein the visual and sound driving circuit further comprises a memory to store a variety of noises.

* * * * *